United States Patent [19]

Reboux

[11] 4,432,093

[45] Feb. 14, 1984

[54] MELTING DEVICE BY DIRECT INDUCTION IN A COLD CAGE WITH SUPPLEMENTARY ELECTROMAGNETIC CONFINEMENT OF THE LOAD

[75] Inventor: Jean Reboux, Massy, France

[73] Assignee: SAPHYMO-STEL-Ste. d'Applications de la Physique Moderne et d l'Electronique, Massy, France

[21] Appl. No.: 333,165

[22] Filed: Dec. 21, 1981

[30] Foreign Application Priority Data

Dec. 23, 1980 [FR] France ..... 80 27320

[51] Int. Cl.[3] ..... H05B 5/16; H05B 11/00

[52] U.S. Cl. ..... 373/157; 219/10.49 R; 373/144

[58] Field of Search ..... 373/159–158, 373/144, 146; 219/10.49 R

[56] References Cited

U.S. PATENT DOCUMENTS

| | | | |
|---|---|---|---|
| 1,801,791 | 4/1931 | Breisky et al. | 373/150 |
| 3,461,215 | 8/1969 | Reboux | 373/156 |
| 3,520,980 | 7/1970 | Sterling et al. | 373/157 |
| 3,531,574 | 9/1970 | Sterling et al. | 373/156 |
| 3,709,678 | 1/1973 | Helary et al. | 373/158 X |
| 3,775,091 | 11/1973 | Clites et al. | 373/155 X |
| 4,215,738 | 8/1980 | Gaule et al. | 164/467 |
| 5,582,528 | 6/1971 | Seale et al. | 373/156 X |

FOREIGN PATENT DOCUMENTS

| | | | |
|---|---|---|---|
| 1147714 | 4/1963 | Fed. Rep. of Germany . | |
| 2406386 | 9/1975 | Fed. Rep. of Germany | 373/155 |
| 1508992 | 10/1966 | France . | |
| 2397251 | 7/1977 | France . | |
| 1221909 | 2/1971 | United Kingdom . | |
| 1234369 | 6/1971 | United Kingdom . | |

*Primary Examiner*—Roy N. Envall, Jr.
*Attorney, Agent, or Firm*—Roland Plottel

[57] ABSTRACT

A direct induction furnace or device for melting a charge held in a cold sheath or shroud with electromagnetic confinement of the conducting portions of the charge. The cold shroud comprises a cylindrical sidewall, which is composed of a plurality of juxtaposed segments in the shape of a hairpin inductor, each formed by two parallel tubular conductors, which are insulated from each other along their entire interface with the exception of a transverse section which electrically and hydraulically connects one end of one of the sections to the adjacent end of the other section.

The other ends of these two conductors are, respectively, electrically and hydraulically connected by tubular conductors to two tubular ring-shaped collectors which are respectively electrically connected to two output terminals of a second generator of alternating current of medium or high frequency, in such a way that the alternating currents which thus flow through the cluster of tubular conductors making up the cold shroud, flow alternately in opposite directions so as to generate forces of repulsion at the periphery of the conducting portion of the charge, which is thus kept away from the shroud sidewall, thereby ensuring a supplementary confinement thereof.

10 Claims, 2 Drawing Figures

MELTING DEVICE BY DIRECT INDUCTION IN A COLD CAGE WITH SUPPLEMENTARY ELECTROMAGNETIC CONFINEMENT OF THE LOAD

The invention relates to a device for melting a charge by direct induction in a cold sheath or shroud with supplementary electromagnetic confinement of the charge, so that its electrically conducting portion is kept away from the inner face of the shroud sidewall.

BACKGROUND OF THE INVENTION

The methods or devices or furnaces for direct induction melting in a cold shroud having a sidewall formed of an assembly of tubular sections of electrically and thermally conducting material, insulated from each other and consequently substantially transparent to an alternating magnetic field created by an inductor which surrounds at least a portion of its height, are well known and described, e.g. in the following publication FR-A-No. 1,492,063, (or DE-B-No. 1,615,195, GB-A-No. 1,130,070 or U.S. Pat. No. 3,461,215 which correspond thereto) where the process is applied especially for the melting of refractory oxides or their mixtures which are not conductors while cold, FR-A-No. 2,036,418 where the process is applied particularly to the elaboration of certain metals from their halogenides by calciothermical action, for example, and FR-A-No. 2,052,082 where the process is applied in particular to the elaboration of certain metals from one of their oxides by direct reduction by means of an alkaline or alkaline earth reducing metal (such as calcium) and its fluoride used as a solvent, as well as the publication GB-A-No. 1,221,909 in which a different embodiment is described where an assembly of tubes with circular cross-section is used for melting charges made of substances which are electrical conductors while cold.

The charge to be melted is generally introduced into the cold sheath or shroud whose bottom is closed by a refractory or a metallic plate which is hollow and cooled, from above in pulverized or granular form. If it consists of a mixture of materials, at least one of which is insulating while cold, the latter accumulates upon melting near the inner face of the sidewall of the cold shroud in such a manner as to form a thin electrically and thermally insulating sheath or layer which covers it. However, when the charge is metallic (i.e. of metal or alloys of metal) and conducting at substantially all temperatures, the sheath formed in contact with the cold wall is also conductive and short-circuits the insulated elements (segments of copper tubing) of the shroud. In both previously mentioned cases, a sufficiently large portion of the heat provided by the currents induced in the charge is transmitted by conduction to the cold shroud from which it is removed by transfer of heat to the cooling fluid circulating there, and in the latter case moreover a considerable portion of the induced current flows through the inner faces of the conducting segments of the cold shroud which are connected together by the conductive charge. This leads to considerable loss of power and heat, thus reducing the effeciency of the prior art direct induction melting processes.

These shortcomings could be reduced by an electromagnetic confinement of the molten charge which is electrically conductive in all cases, by means of an alternating magnetic field.

The electromagnetic confinement of a flow of liquid metal by means of an axial alternating magnetic field is known per se, for example, from publications GB-A-No. 893,445, FR-A-Nos. 1,509,962, 2,106,545, 2,160,281, 2,316,026 and 2,396,612. In these prior art electromagnetic confinement devices, the axial magnetic field of confinement is provided by means of an inductor supplied by alternating current, coaxially surrounding the crucible containing the melt or the nozzle for casting which projects below through its bottom, substantially at the level of its lower opening.

It has also been disclosed (see GB-A-No. 1,221,909) that the currents induced in the segments of the cold shroud at about the level of the inductor, which follow the circumference of the insulated conductor elements whose cluster makes up the sidewall of the cold shroud, exert on the portion of the charge which is within the field of the inductor, forces of constriction or confinement, due to which its periphery is being forced away from contact with the inner face of the sidewall of the cold shroud. This effect of repulsion is substantially limited to the area surrounded by the heating inductor and uses up a good portion of the energy with which it is supplied and which is removed by the cooling fluid which flows through the shroud. The combination of a confinement inductor coaxially with the heating inductor poses problems of mutual coupling and of insufficient coupling to the periphery of the charge, due to the fact that the sidewall of the cold shroud is present between the charge and the inductors.

Experience has shown that when direct induction molten materials are, after cooling, removed from the cold shroud in the form of ingots obtained by axial displacement (toward the bottom) of the "sole" closing its bottom (see, for example FR-A-No. 2,303,774), the ingot has surface irregularities in the form of longitudinal ridges at the places of the separations between the segments of the cage where the effect of cooling is less efficient.

Another electromagnetic confinement process has been described in the publication DE-B-No. 1,147,714 where one utilizes for the transferring or keeping in suspension of the body of liquid conducting materials (flow) or solids, an assembly of parallel conductors which surround them in the manner of a tubular case and which are traversed by alternating currents of the kind where the currents in adjoining conductors flow in opposite directions, respectively. A similar confinement process has been described in publication FR-A-No. 2,397,251.

A horizontal furnace for direct induction with electromagnetic suspension of the charge of solid conductive material has been described in the publication FR-A-No. 1,508,992 where an inductor with three longitudinal strands (parallel to the horizontal axis), two of which are connected in parallel and one of which (the lowest) is connected in series with the others to form a suspension cradle, is surrounded by a cylindrical single-turn or solenoid inductor which assures the heating of the metallic body and contributes to maintaining it in suspension, especially when it is in the process of melting. Such a horizontal furnace without crucible cannot be used for divided charges (pulverized or granulated) and neither does it allow continuous casting nor the extraction of ingots or crystals. Moreover, its maximum charge is limited to several kilograms because of the necessary suspension force which opposes gravity.

A method and a device for so-called electromagnetic casting of molten metals and alloys has been described in the publication U.S. Pat. No. 4,215,738 where the shape of the ingot is mainly determined by means of a single-turn shaping or confinement inductor which surrounds it coaxially and which is fed from a first power source by a first alternating current (see, for example, publications FR-A-Nos. 1,509,062 and 2,106,545, previously cited) and where more precise shape control of some of the ingot sidewalls is obtained by means of additional confinement inductors which are called anti-parallel grids and which comprise vertically oriented strands of conductors interconnected in such a way as to make neighboring strands carry currents in respectively opposite directions. These antiparallel grids are inserted between the main single-turn inductor and certain sidewalls of the ingot and are provided with two terminals connected to a second power source. More precisely, these "anti-parallel" inductors are formed with the help of several straight conductor strands parallel to the vertical axis of the ingot and connected in series in such a manner that the currents which traverse the neighboring strands flow in opposite directions respectively, to exert on the upper molten part of the ingot electromagnetic forces of repulsion (confinement) which are added to those due to the action of the main inductor and which are similar to those mentioned in the publication DE-B-No. 1,147,714 cited above.

SUMMARY OF THE INVENTION

It is an object of the present invention to provide a device for melting by direct induction of a charge contained in a cold shroud or sheath whose cylindrical sidewall is formed by a cluster of tubular conductors carrying cooling fluid, which are interconnected, according to the invention, in such a way as to form one or several "anti-parallel" inductors which thus serve at the same time as a cold shroud and as an additional confinement device, thus allowing it to receive, in particular, pulverized or granular (divided in particles) charges of different materials. This melting device is oriented vertically to allow the casting of molten material or the extraction of ingots (known per se) and therefore the supplementary magnetic field of confinement need not overcome gravitation and can act upon the molten portion of the charge when it is insulating while cold, to facilitate the formation of a layer of powdered, granular or agglomerated (sintered) part of the charge (protective layer) which takes the place of a crucible and whose thickness, which in this case is increased, ensures a better thermal insulation of the molten portion. When the charge is conducting while cold, the magnetic field of confinement generated by the currents flowing along segments of the shroud can also act upon the unmolten upper portion of the charge, if their intensity exceeds a certain threshold.

According the the invention, the insulated tubular conductors whose cluster makes up the sidewall of the cold shroud, are electrically interconnected and connected together to a separate power source in such a way that it constitutes at the same time a confinement inductor or a plurality of such inductors, of a type known per se. The electrical interconnections of the adjacent ends of two neighboring parallel conducting segments of the shroud sidewall can be carried out by electrical connecting means of tubular or plate-like forms for forming hairpin-shaped inductors whose two parallel conducting strands respectively conduct the same current in opposite directions, if connected to the output terminals of a second power generator supplying a second alternating current having a second medium or high frequency, preferably different from the one of the current flowing through the main heating inductor. The alternating currents flowing through the vertical parallel conductor strands, which are of alternately opposite directions, generate magnetic fields which induce in the periphery of the conducting portion of the charge, currents whose interaction with those of the strands provide electromagnetic forces of repulsion, i.e. of additional confinement.

These electrical connecting means can be formed of conducting plates or of transverse tubular sections which connect, for example, by one of their respective adjacent ends two neighboring tubular sections in such a way as to form segments in the form of hairpins which are assembled side by side in an electrically insulated manner to form the sidewall of the cold shroud.

In different embodiments of the cold shroud which is at the same time a confinement inductor, the hairpin segments, forming the sidewall are, respectively, electrically connected in parallel, in series or in different series-parallel combinations, so that an assembly of inductor elements thus connected can form an impedance adapted to the frequency of the second generator.

The power of supplementary confinement supplied by the second generator is a function of the diameter and of the height of the cold shroud and, consequently, of the volume of the charge. It is generally comprised between one tenth and one fifth of the power supplied by the first generator to the main inductor surrounding the shroud.

In a process of utilizing the melting device with supplementary confinement according to the invention, one adds to the charge to be molten, when all its components are metallic i.e. conducting while cold, a small proportion of a substance which is insulating while cold and which has a melting point lower than that of the metal or alloy, to form a slag. This slag, preferably of fluorite (or calcium fluoride) or of silica, possibly mixed with additives such as borates, has in the molten state a surface tension which is noticeably lower than that of the metal with which it is mixed in the form of a powder and is, for this reason, ejected from the stirred molten metal and propelled toward its periphery, where it solidifies when coming into contact with the cold shroud and becomes insulating again. With the forces of confinement having no longer any effect on the insulating slag, it is now moved by the bath toward the internal faces of the shroud to form there an insulating protective coating. One preferably uses a proportion by weight of 0.5 to 1.5% relative to the total weight of the charge.

BRIEF DESCRIPTION OF THE DRAWINGS

The invention will be better understood in its features and advantages by referring to the following description and the attached drawings, which show examples and in which.

DESCRIPTION OF THE PRIOR ART

Figure 1:
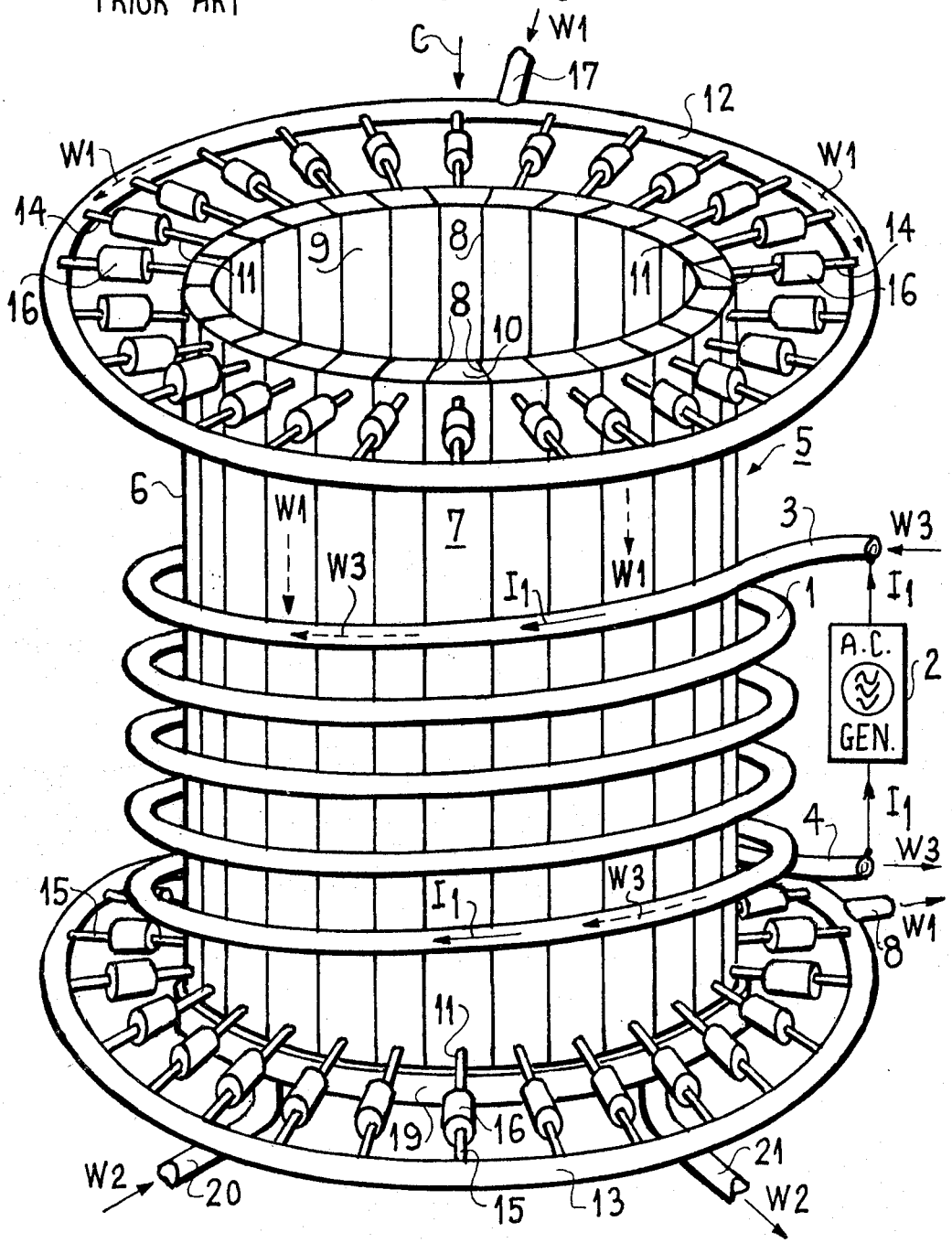
PRIOR ART FIG 1
FIG. 1 is a schematic view in perspective of a device for melting by direct induction in a cold shroud according to the prior art.

The prior art melting device of FIG. 1 comprises a heating inductor 1 of helicoidal shape (solenoid) made of copper tubing and comprising several turns which cover a predetermined height. The two ends 3, 4 of this inductor 1 are respectively connected to two output terminals (low impedance, for example) of a first power generator 2 for delivering an alternating current $I_1$ of high (30 kHz–10 MHz) or of medium (1–30 kHz) frequencies (industrial) which are intended, respectively, for the melting of refractory materials which are insulating while cold such as oxides or silicates, for example, or semi-conductors, such as silicon, germanium or arsenide, for example, and of conducting materials, such as metals or alloys of metals.

The power supplied to the inductor 1 is a function of the nature of the material (melting point, resistivity at low and high temperatures, relative permeability up to the Curie point, etc.), of the volume of the charge to be melted (i.e. the diameter of the cold shroud and the height of the inductor 1) and of the coupling factor between the charge and the inductor (thickness of the shroud sidewall). The generator 2 must, consequently, be dimensioned in such a way that it supplies a power between 50 and 250 kW, for example.

The cold shroud or "auto-crucible" 5 comprises a cylindrical sidewall 6 with a vertical axis of symmetry, consisting of a great number of juxtaposed tubular segments 7 which are of elongated shape and are oriented in parallel to the geometrical axis or to the generatrix of the cylinder which they form together. These segments 7 can be formed as sections of metallic tubes of rectangular, circular, trapezoidal cross section or defined as shown, in FIG. 1, by two concentric circular arcs whose center coincides with the axis of the wall 6 and two straight radial sections having one intersection on this axis (see, for example, FR-A-No. 1,492,063). The oppositely situated lateral walls (radial) of adjacent segments 7 are insulated from each other by means of an insulating layer 8 in the form of an electrically insulating coating, for example, of a ceramic material (alumina or other) which may be sprayed on it or by means of rigit separating plates or ribbons of felt or tissue of a like insulating material, preferably refractory, inserted between the walls.

When it is necessary to melt by direct induction materials which are electric conductors when cold, such as metals or metal alloys, it may prove advantageous to also clad by a layer of insulating and refractory material the inwardly facing walls 9 of the segments 7 which are adjacent to the charge and which form together the inner face of the sidewall 6 of cold shroud 5 or to provide it with a thin insulating interior covering of cylindrical shape, made of such a material.

In order to assure the cooling of said sidewall, each end of the tubular sections forming the segments 7 is covered by a transverse plate 10 and provided with tubular connecting end sections 11, which are respectively radially oriented outward projections therefrom. The circulation of cooling fluid (water) is assured by an inlet collector ring 12 and a outlet collector ring 13 of greater diameters than the outer one of the shroud sidewall 6 as well as that of the heating inductor 1.

Said collector rings 12 and 13 are provided, respectively, with connecting pieces 14 and 15, which are tubular, radially oriented inward projections therefrom, which pieces are hydraulically connected to the pieces 11 of the segments 7 by means of insulating tubular joints 16, preferably flexible, in such a way as to keep the segments 7 electrically insulated from each other. Said annular collectors 12, 13 are joined, respectively, with the aid of other tubular pieces 17, 18 with a refrigerating fluid circuit (not shown) whose circulation occurs in the direction of the arrow W1.

The bottom of the cold shroud 5 is closed by means of a base or sole 19, also cooled, either in the form of a hollow metallic disk connected by two tubes 20, 21 to another fluid circuit indicated by arrows W2, or in the form of a ceramic disk (see, for example, GB-A-No. 1,130,070) whose bottom is cooled by sprinkling water thereon, for example. Said sole 19 can be made with the aid of sectors, insulated from one another, or in the form of a ring having a central opening for the insertion of a casting nozzle which has to be heated to let the molten substance flow (see FR-A-Nos. 1,188,576 or 2,054,464, for example).

When the sole 19 is of a conductive material and the charge to be molten is conductive when cold, it may be advantageous to completely cover its upper face by a coating or by a lining of insulating material (ceramic).

The periphery of the top face of the sole 19 on which rests the bottom of the shroud sidewall 6, is preferably insulated therefrom in all embodiments of the shroud, for example, by means of a round piece of ceramic felt or a layer of powder of an insulating refractory material (alumina, for example).

It will be noted that the heating inductor 1 which surrounds the sidewall 6 of the shroud 5 and which generates the alternating axial magnetic field for the melting by direct induction of the charge and the stirring of the liquid bath, is also formed as a tube and connected to a circuit of cooling fluid indicated by the arrows W3. One further notes, as could be observed in shroud 5, an effect of constriction caused by the inductor 1 on that part of the liquid bath which is level therewith.

The charge is introduced into the shroud 5 in powder or granular form by means of a hopper (not shown) from above, in the direction of arrow C.

DESCRIPTION OF THE INVENTION

Figure 2:
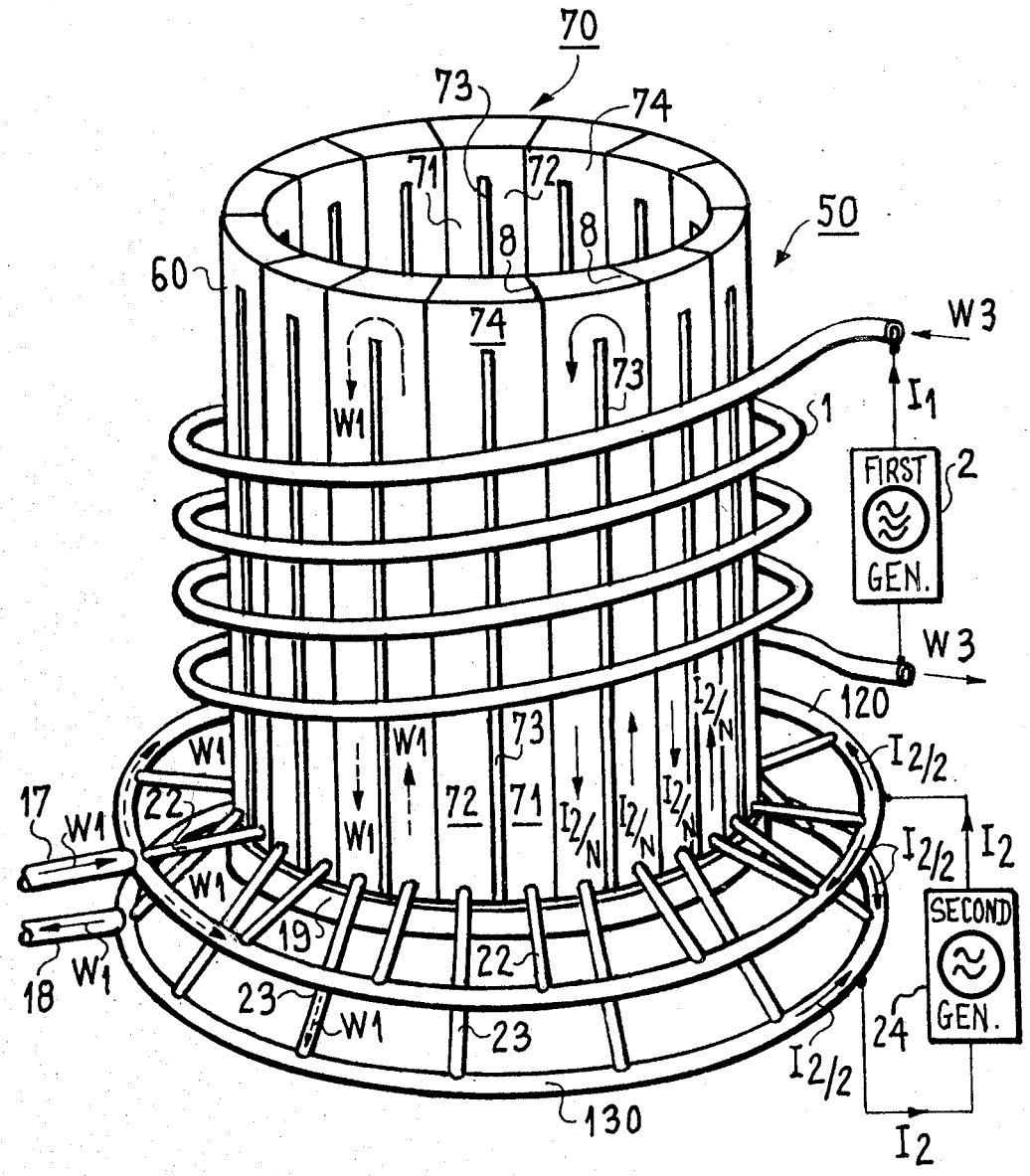
FIG. 2 is a schematic view in perspective of an embodiment of the device for melting by direct induction with supplementary electromagnetic confinement of the charge in which, for the purpose of the simplicity of the drawing, the segments in form of hairpins are connected in parallel.

FIG. 2 is a perspective view of an embodiment with a vertical direct induction furnace or melting device with supplementary electromagnetic confinement of the charge according to the invention.

In FIG. 2 the segments 70 which form the sidewall 60 of the cold shroud 50 are made up from hairpin-(or "U-") shaped tubular elements, each of which includes two straight parallel tubing sections 71, 72 placed side by side and separated from each other by a gap 73 which can be filled out by a piece of ceramic felt or by a ceramic layer. The two parallel tubing sections 71, 72 are electrically and hydraulically interconnected at one of their respective adjacent ends by means of a transversely oriented (circumferential) connecting section of tubing 74 which is perpendicular to the two parallel sections 71, 72.

These segments 70 are juxtaposed just as in the prior art in such a way as to form the cylindrical sidewall 60 of the shroud 50 whose bottom is covered by a known sole 19 (see FIG. 1 and the state of the art as mentioned above).

As distinguished from the prior art with respect to the cold shroud 50, the adjacent free ends (not connected) of the sections 71, 72 which form a single segment 70, are respectively, hydraulically and electrically connected by outwardly projecting, substantially radially oriented joints or tubular metallic conductive sections 22, 23—the ones (22) of which being perpendicular to the vertical axis of the sheath 50, and the others (23) of which being inclined (slanted) relative to this axis—to two metallic hollow annular collectors 120, 130 with the first (120) of which comprising the inlet tube 17 and the second (130) of which comprising the outlet tube 18 for the cooling fluid for the cage 50, whose direction of flow is indicated by the arrows W1.

The respective electrical connection between the annular collectors 120, 130 and the respective ends of the segments 70 in the shape of hairpins, allows, by connecting them, respectively, to the two output terminals of a second power generator of alternating current 24, the two parallel sections 71, 72 of each segment 70 to carry alternating electric currents in two opposite directions, respectively.

The magnetic fields which are given rise by the alternating currents which flow along the parallel assembled tubing sections 71, 72 of the shroud sidewall in opposite directions, induce within the periphery of the conductive molten charge, currents which are substantially of the same intensity and of opposite phases, due to a proximity effect.

These two currents act upon are another in such a way as to create, at the periphery of the liquid bath, centripetal forces (of Laplace), i.e. forces of repulsion, substantially uniformly distributed over the periphery of the bath and oriented radially in the direction of its geometrical axis.

These forces of repulsion are added to the forces of constriction due to the action of the heating inductor 1 supplied by the first generator 2 and thus constituting supplementary forces of confinement which act upon the charge. When the charge is mainly composed of substances which are electrically insulating when cold and which become conducting when they reach their temperatures of inductibility and whose melting point is close to this temperature, these supplementary forces of confinement allow the formation over the entire height of the liquid bath (the molten charge), between the periphery thereof and the inner face of the shroud 50, of a thin layer of air, gas or vacuum (when the melting takes place under vacuum) of several tenths of a millimeter, which is then filled out by those portions of the substance forming the charge which remain cold or which become cooled when entering into contact with the shroud. Thus the supplementary confinement due to the alternating currents flowing through the segments 70 provide a greater thickness of the insulating layer separating the shroud from the melt and thereby a better thermal and electrical insulation thereof, relatively to that provided by the prior art device of FIG. 1.

Such an arrangement thus allows to reduce noticeably the thermal and electrical losses by conduction, the risk of leakage (flowing) of molten material and the contamination of the charge during melting by the materials of which the shroud 50 is made.

When the load is mainly composed of substances which are insulating while cold and conducting when heated above their temperature of inductibility which is however is much lower than their respective melting points (as in the case of certain oxides of refractory metals), the force of confinement generated by the currents flowing in the shroud 50 according to the invention act also upon those solid portions of the load, which have exceeded the temperature of inductibility, which are removed from the interior wall and replaced by insulating particles (grains) of the substance.

The situation is similar in the case where the charge is composed of conducting substances, such as metals and their alloys, the periphery of which is forced away from the inner face of the shroud sidewall 50 substantially up to the transverse sections 74 (i.e. up to the ends of the gaps 73 separating the respective longitudinal sections 71, 72 of the hairpin segments 70), even as far as the not yet molten powdered or granular portions of the charge are concerned, this however is a smaller measure than that of the molten portion which is in the field of the heating inductor 1.

The preferred method of using of a direct induction melting device with a cold shroud arranged for providing supplementary electromagnetic confinement of the charge, when the charge is purely metallic, consists in adding thereto in its divided state (pulverized or granular) a small quantity of a substance, which is insulating while cold and which has a temperature of inductibility close to its melting point which has to be at least slightly lower than that of the metal or alloy making up the useful charge. This additional substance is used to form a slag in the melt. This slag is so chosen as to have in its molten state a surface tension noticeably lower than that of the metallic charge. This slag is therefore expelled from the bath of molten metal towards its periphery where it fills the space left free due to the forces of confinement and where, upon contact with the inner face of the cold shroud sidewall, its cools down so as to solidify and become insulating again. More precisely, the slag losses its inductibility under the effect of the shroud 50 and fills the peripheral space between the shroud and the charge, by forming there a protective coating which is electrically and thermally insulating. The mixture which makes up the charge comprises in this case a proportion by weight of between 0.5 and 1.5% of the substance forming the slag (of preferably fluoride—$CaF_2$) or silica, possibly mixed with additives such as borates which allow lowering of its melting point to around 1400° C.

The embodiment of cold shroud 50 arranged according to the invention to also constitute a supplementary confinement inductor, which has been illustrated on FIG. 2 and described hereinabove, is made up from an assembly of hairpin-shaped inductors each of which forms a segment 70 of the shroud sidewall and which are electrically connected in parallel by means of two annular collectors 120, 130 which are in turn respectively connected to two low-impedance output terminals made, for example, of the terminals of a secondary winding of an impedance-matching transformer (not shown) whose primary winding is connected to the terminals of the second generator 24. These inductors (in U 70) are each supplied by a current $I_2/N$ of several tens R.M.S. amperes (where N is the number of segments 70 forming the shroud 50), whose exact intensity is determined experimentally as a function of the dimensions of the bath and the effect of the constriction already supplied by the heating inductor 1, so that they produce an adequate amount of supplementary electromagnetic confinement.

Experimentation has shown that a power noticeably less than that consumed by the inductor 1 is sufficient for supplying the segments 70 of the shroud 50 in parallel and to obtain sufficient confinement of the conducting portion of the charge.

The second generator 24 which supplies in parallel the inductors of the shroud 50 must thus deliver, for example, a power between a fifth and tenth of the one delivered by the first generator 2 to the inductor 1 (from 50 to 250 kW). The result thereof is that a power in the order of several kW to several tens of kW (10 to 30 kW, for example) is sufficient for the electromagnetic confinement for charges of metal or alloys of metal.

One uses for the melting-stirring and for the confinement by the shroud 50, preferably the same frequency groups, i.e. the high frequencies of 30 kHz to 10 MHz for the refractory oxides, the silicates and the semiconductors, and the medium frequencies of 1 to 20 kHz for the melting of metals or alloys. However, one preferably chooses different frequencies to carry out the operations of melting and stirring by the heating inductor 1 and the operation of electromagnetic confinement by the shroud 50 which are distinct functions, separately controllable by means of two generators. It is also possible to use the range of high frequencies for the heating and the stirring and the range of medium frequencies for the confinement, or vice versa.

To summarize, the main advantage of the electromagnetic confinement according to the invention by the shroud is that the periphery of the conducting portion of the charge even when it is composed of a metallic material, is kept away from the inner face of the sidewall 60 thereof, on substantially over its entire height and not only at about the level of the main inductor 1, with a concomitant reduction of the thermal losses by conduction and of the risks of leakage through the gaps of the sidewall 60.

It is to be remarked here that instead of connecting the two free ends of each hairpin-shaped inductor to two distinct annular collectors 120, 130, it is possible to interconnect them electrically and even hydraulically in series, i.e. to connect them, for example, by means of transverse connecting sections, similar to those indicated by the numeral 74, the lower end of a tubular section 71 of one segment 70 to the corresponding lower end of a tubular section 72 of a neighboring segment. One obtains thus a single serpentine inductor of high impedance. It is also possible to make series-parallel combinations of said hairpin-shaped inductors by connecting a number thereof in series to form several groups of equal inductance and to connect these groups in parallel to obtain the impedance which is required as a function of the dimensions of the shroud 50 and the frequency of the second generator 24, chosen as a result thereof.

The electrical connections between the longitudinal tubular sections 71, 72 are not necessarily made with the aid of the transverse sections 74 which also assure the hydraulic continuity. It is further possible to assure the feeding of cooling fluid in the manner shown in FIG. 1, i.e. by utilizing insulating tubular joints, and the electric supplying in series by means of transverse, metallic, conductive plates (of copper, for example) in the form of arcs of a circle of sufficient length to cover at least partially the ends (10, FIG. 1) of two adjacent sections (7, FIG. 1) to form a hairpin-shaped segment 70. Said connecting plates (not shown) can be rendered mechanically and electrically integral with the ends of the sections which they cover by welding or hard-soldering. They can even replace the end plates (10, FIG. 1) which close the ends of the tubular sections (7, FIG. 1) which they must then cover completely. By utilizing connecting plates of the same dimensions, it is possible to make serpentine inductors as mentioned above, where all sections are connected in series.

The segments 70 can be made from metal tubes of copper or of an alloy of copper (brass, bronze) or of an alloy of nickel with other metals, such as copper or chrome. For the melting of refractory metals or alloys, for example, it is advantageous to use an alloy of nickel, of chrome and of iron (0.78 Ni+0.14 Cr+0.07 Fe), which is commercially available under the name "INCONEL" (trademark registred by the U.S. manufacturer International Nickel Co.) and which is particularly suitable for high temperatures.

I claim:

1. Device for direct induction melting of a charge, including: a cold shroud for holding said charge, said shroud having a cylindrical sidewall and a vertical axis of symmetry, said sidewall including a plurality of electrically conducting elongated tubular sections assembled side by side, oriented parallel to said axis and electrically insulated from each other, a solenoid-shaped inductor coaxially surrounding said sidewall, a first alternating current power generator and first means for connecting said first generator to said inductor for inducing heating current within the charge and for exerting first forces of confinement acting on the periphery of the charge portion located within the field of the inductor, means for electrically interconnecting said tubular sections at their respective ends, two by two, for forming at least one further confinement inductor, a second alternating current power generator and second means for connecting said second generator to said at least one further inductor, said means for interconnecting being so arranged that alternating current flows through all conducting sections of the sidewall in alternately opposite directions for generating a further electromagnetic force of confinement, keeping the conducting portions of the charge away from said sidewall, which thereby simultaneously carries out both cooling and confinement functions.

2. Device as claimed in claim 1, wherein said interconnecting means comprise third electrical connecting means, each connecting one end of one tubular section to the adjacent corresponding end of another neighboring tubular section, whereby to obtain a plurality of hairpin-shaped sidewall segments which are insulated from each other.

3. Device as claimed in claim 2, wherein the respective free ends of said hairpin-shaped segments are coupled by said second connecting means to said second generator terminals in parallel.

4. Device as claimed in claim 2, wherein said interconnecting means further comprises fourth electrical connecting means, each connecting one free end of a hairpin-shaped segment to the adjacent free end of the neighboring segment, whereby to obtain at least one serpentine-shaped confinement inductor by connecting a plurality of the hairpin-shaped segments in series.

5. Device as claimed in claim 4, wherein said third and fourth electrical connecting means provide a plurality of serpentine-shaped inductors of equal impedance and wherein said second connecting means are so arranged as to couple them in parallel to the terminals of said second generator.

6. Device as claimed in one of claims 2, or 4, wherein at least one of said third and fourth electrical connecting means is made up from tubular sections for providing both electrical and hydraulic continuity.

7. A method of using for direct induction melting of a charge contained in a cold shroud having a cylindrical sidewall made up from an assembly of conducting, vertically oriented tubular sections cooled by a flow of cooling fluid and surrounded by a heating inductor of solenoid-shape, said tubular sections being insulated from each other, including the adding to a metallic charge before its introduction into the shroud, of a substance which is insulating when cold and which has its temperature of inductibility and melting point close to each other and lower than the melting point of the metal forming the charge, said insulating substance forming a slag which is expelled from the melt towards its periphery for providing, when cooled by the contact with the shroud sidewall, an electrically and thermally insulating layer, wherein the improvement comprises the passing of alternately oppositely directed alternating currents along said tubular sections forming said shroud, by electrically interconnecting them at their respective adjacent ends, two by two, to obtain hairpin-shaped inductors, and by connecting said hairpin-shaped inductors thus obtained to a generator, whereby to generate an eletromagnetic field of supplementary confinement acting on the conducting portions of the charge and to increase said insulating layer thickness.

8. Method as claimed in claim 7, wherein the ponderal proportion of the slag-forming substance is 0.5 to 1.5 percent of the total weight of the charge.

9. Method as claimed in one of claims 7 or 8, wherein the slag-forming substance contains silica.

10. Method as claimed in claims 7 or 8, wherein the slag-forming substance contains silica and at least one borate.

* * * * *